US005865350A

United States Patent [19]

Losenno et al.

[11] Patent Number: 5,865,350

[45] Date of Patent: Feb. 2, 1999

[54] SPRAY BOTTLE WITH BUILT-IN PUMP

[75] Inventors: Christopher D. Losenno, Edina; William M. Mower, Plymouth; Gino L. Losenno, Edina, all of Minn.

[73] Assignee: Pure Vision International L.L.P., Minneapolis, Minn.

[21] Appl. No.: 787,259

[22] Filed: Jan. 24, 1997

[51] Int. Cl.[6] ..... B65D 35/00

[52] U.S. Cl. ..... 222/402; 222/105; 239/372

[58] Field of Search ..... 222/401, 402, 222/105, 386.5; 239/353, 372, 418, 373

[56] References Cited

U.S. PATENT DOCUMENTS

| | | | |
|---|---|---|---|
| 3,225,967 | 12/1965 | Heimgartner | 222/105 |
| 3,559,701 | 2/1971 | Wittersheim et al. . | |
| 3,592,390 | 7/1971 | Morse . | |
| 3,792,802 | 2/1974 | Gores . | |
| 3,827,608 | 8/1974 | Green . | |
| 3,838,796 | 10/1974 | Cohen . | |
| 3,901,416 | 8/1975 | Schultz . | |
| 3,955,720 | 5/1976 | Malone | 222/401 |
| 4,147,284 | 4/1979 | Mizzi . | |
| 4,482,082 | 11/1984 | Goncalves . | |
| 4,492,320 | 1/1985 | Tada . | |
| 4,513,890 | 4/1985 | Goncalves . | |
| 4,619,297 | 10/1986 | Kocher . | |
| 4,646,947 | 3/1987 | Stall . | |
| 4,813,575 | 3/1989 | O'Connor . | |
| 4,921,020 | 5/1990 | Pamper . | |
| 4,925,066 | 5/1990 | Rosenbaum . | |
| 4,953,753 | 9/1990 | Gortz . | |
| 4,984,717 | 1/1991 | Burton . | |
| 5,115,944 | 5/1992 | Nikolich | 222/105 |
| 5,165,576 | 11/1992 | Hickerson . | |
| 5,224,528 | 7/1993 | Helmut et al. . | |
| 5,507,420 | 4/1996 | O'Neill . | |

*Primary Examiner*—Steven O. Douglas
*Attorney, Agent, or Firm*—Haugen and Nikolai, P.A.

[57] ABSTRACT

A spray container for dispensing a liquid product as a fine mist incorporates a compliant bag-like inner reservoir in which the product to be dispensed resides. The container incorporates a built-in air pump for charging the chamber defined by the outer container with compressed air. A valve mechanism is provided which when actuated by depression of a push-button, causes a mixture of the compressed air and liquid to be dispensed to be ejected as a fine mist through a spray orifice.

6 Claims, 1 Drawing Sheet

SPRAY BOTTLE WITH BUILT-IN PUMP

BACKGROUND OF THE INVENTION

I. Related Applications

The present invention relates to application Ser. No. 08/688,657, filed Jul. 29, 1996, and entitled "REUSABLE PRESSURE SPRAY CONTAINER".

II. Field of the Invention

This invention relates generally to product packaging and dispensing apparatus, and more particularly to a refillable container for dispensing liquid products as a fine mist or spray and including a built-in pump for pressurizing the container.

III. Discussion of the Prior Art

Spray bottles or cans including an air pump mechanism for injecting air under pressure into the container by actuation of a sliding piston in a cylinder is known in the art. In this regard, reference is made to the Tada Patent 4,492,320 which describes a spray can including a cylindrical container for the liquid to be dispensed and a dispensing tube leads from a location at the bottom of the liquid out through a dispensing valve to the atmosphere. Built into the container is a pump structure having an outer cylinder that extends coaxially within the container for a substantial length of the container and the air outlet ports from this cylinder are located at the top thereof so that they will be above the liquid level. An elongated piston rod connects a reciprocally movable base member to a piston head that is reciprocally movable within the pump cylinder. As the base member and attached piston are reciprocated, the air pressure is built up above the surface of the liquid, thus forcing the liquid up through the dispensing tube and out the dispensing valve when the thumb is used to depress and thereby open the dispensing valve.

Because the pressurizing pump occupies a substantial portion of the available volume within the container, it limits the amount of product that can be dispensed from a can of a given size. Moreover, the container described in the Tada patent is permanently sealed following the filling thereof and, thus, is incapable of being refilled with product once empty.

In this design, only the liquid product being dispensed rises up the tube and none of the compressed air is introduced into the liquid stream to create a fine mist. A fine mist is desired where quick drying of the spray is desired.

Thus, a need exists for a spray can or bottle that is capable of being refilled and which can be repressurized by a built-in pump that occupies only a very small volume of the container, making it possible to dispense a greater volume of product prior to refilling.

SUMMARY OF THE INVENTION

The present invention comprises a spray bottle for dispensing a liquid product as a mist. It includes a generally cylindrical container having open upper and lower ends. A cap member is attached to the upper open end and it includes a central aperture through which a finger-operated dispensing valve push-button may extend. A base member is concentrically disposed about the lower end of the container and is arranged to be reciprocally slidable thereon. Disposed within the generally cylindrical container is a compliant, tubular inner reservoir having a closed lower end and an upper end terminating in a radially extending flange that is dimensioned to fit over the upper end of the container and be held in place by the cap member, with the inner reservoir disposed within the cylindrical container for holding the liquid product to be dispensed. The flange includes a central bore aligned with the aperture in the cap. A dispensing valve means is disposed in the central bore and extends through the aperture in the cap for releasing a mixture of the liquid product and air under pressure as a fine mist. A manually-operated plunger pump is affixed to the base member for introducing pressurizing air into the container as the base member is reciprocally slid relative to the container.

The dispensing valve itself comprises a spring-loaded, tubular piston having a closed lower end, an open upper end and a lumen extending therebetween, the tubular piston including a port that is proximate the closed lower end. The port is in fluid communication with the liquid product and the pressurizing air when the tubular piston is manually depressed to allow the mixture to be dispensed through the open upper end of the tubular piston and out through the orifice in the thumb-actuated push-button as a mist.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which.

DESCRIPTION OF THE PREFERRED EMBODIMENT

Figure 1:
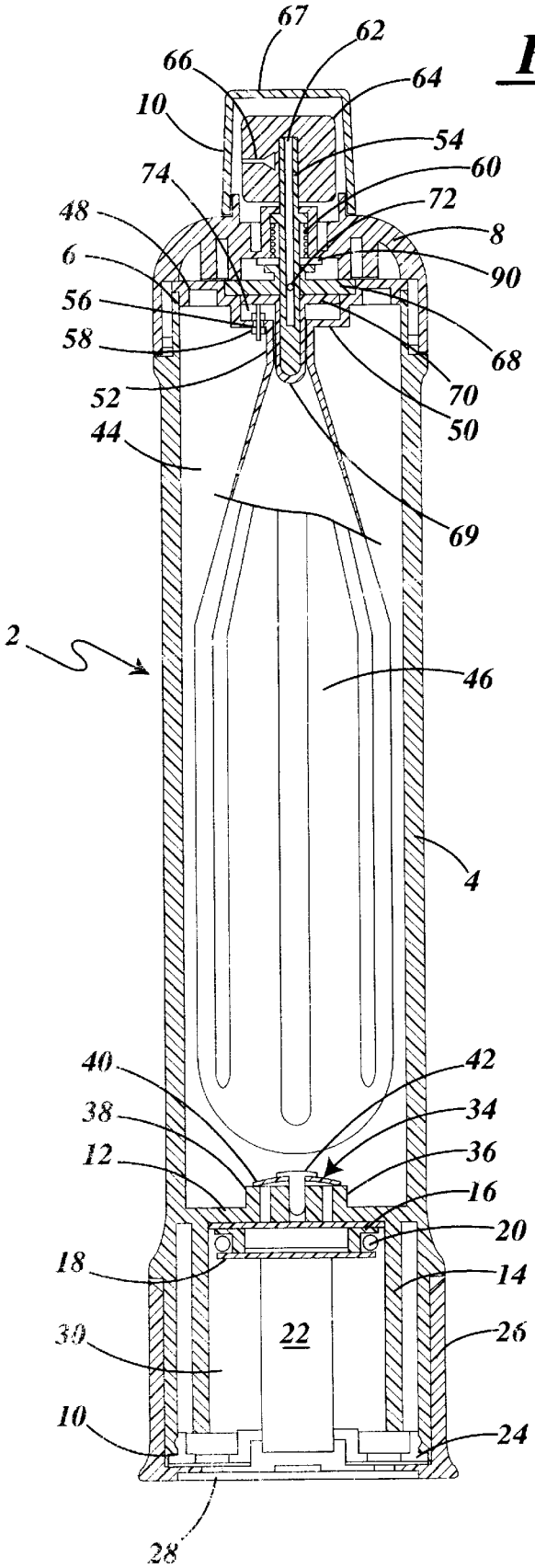
FIG. 1 is a longitudinal cross-sectional view of a preferred embodiment of the spray container of the present invention.

Referring first to the cross-sectional view of FIG. 1, there is indicated generally by numeral 2 a spray container constructed in accordance with the present invention. It is seen to comprise a generally cylindrical rigid outer cylinder 4 which is preferably molded from a suitable plastic but, alternatively, may be formed from metal. The cylinder 4 has an open upper end 6 which is externally threaded to receive a dome-shaped molded plastic cap 8 thereon. In the case of a metal container, the cap may be crimped onto the cylinder. The lower or bottom end 10 of the cylinder 4 is also open.

Integrally molded in the cylinder 4 and located a predetermined distance above the bottom end 10 thereof is a transversely extending baffle 12 that forms the upper end of an integrally molded cylinder 14 that is concentric with the outer wall 4 of the container.

Fitted within the cylinder 14 is a piston assembly 16 comprising a closely fitting piston head 18 supporting an elastomeric O-ring seal member 20 that fits loosely within an annular groove formed in the side wall of the piston head 16. A piston rod 22 connects the piston head assembly 16 to a spider 24 fitted into and affixed to a reciprocally moveable-shaped pump handle 26. The spider 24 includes a plurality of ports as at 28 for admitting air into the cylindrical chamber 30 surrounding the piston rod 22.

Figure 2:
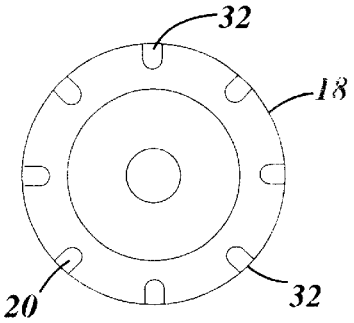
FIG. 2 is a plan view of the piston head incorporated in the built-in pressurizing pump shown in FIG. 1.

Referring to FIG. 2 which is a plan view of the piston head 16, it is seen to include a plurality of U-shaped notches as at 32 that allows air in the chamber 30 to bypass the piston head 16 as the cup-shaped handle 26 is grasped and pulled downward when viewed as in FIG. 1.

Integrally molded with the baffle 12 is a valve assembly 34 that includes a cylindrical valve seat 36 integrally molded with the baffle 12 and which includes a plurality of axially extending bores as at 38. Affixed to the upper end of the valve seat member 36 is a one-way check valve in the form of an elastomeric diaphragm 40 placed in covering relationship relative to the bores 38 and held in place by a fastener 42.

During the return or compression stroke of the piston head 16, the air contained within the chamber 30 is pressurized so as to flow through the bores 38 to lift the elastomeric disk check valve 40 permitting that air to enter the cylindrical chamber 44 defined by the cylindrical wall 4 of the container 2. As the cup-shaped handle 26 is again pulled downward, the elastomeric disk 40 covers the bores 38 preventing the compressed air within the chamber 44 from again exiting.

Contained within the cylindrical chamber 44 is at least one flexible, compliant balloon-like container 46 in which the product to be dispensed as a spray is contained. The balloon may be fabricated from a suitable rubber or elastomer and preferably includes a rippled circumferential wall where the wall thickness varies to a lesser value in the valleys than at the peaks. If multiple inner reservoirs are employed, more than one product can be dispensed as a mist. The inner reservoir(s) 46 has/have a closed lower end and integrally formed at its upper end is a molded plastic flange 48 that is supported on the upper rim of the cylindrical wall 4 and captured in place by the dome-shaped cap 8. The flange 48 has a floor 50 and a downwardly depending neck 52 that forms a portion of the compliant inner reservoir 46. The neck 52 surrounds a central opening adapted to receive a valve stem member 54 therethrough. Also formed in the floor 50 of the radial flange 48 is a port 56 into which is fitted a valve member 58 that normally seals the port 56, preventing the escape of compressed air from the chamber 44.

The valve stem 54 is normally urged upward, as viewed in FIG. 1, by the force of a compression spring 60. The valve stem 54 includes a central longitudinally extending lumen 62 and press fit onto the valve stem 54 is a molded plastic push-button 64 having a spray outlet port 66 extending transversely and in fluid communication with a bore formed transversely through the wall of the valve stem 54 and in fluid communication with the lumen 62 thereof. A removable protective cap 67 is shown covering the push-button 64.

The valve stem 54 passes through a stationary silicon washer 68 whose central aperture is sized to create a fluid tight seal about the exterior of the valve stem 54 while still allowing longitudinal displacement of the valve stem by either thumb pressure applied to the push-button 64 or the force afforded by the return spring 60. Press-fit onto the lower end of the tubular piston 54 is a molded, plastic, cup-shaped sleeve 69 having a radially extending flange 70 surrounding the open end thereof, the flange cooperating with the silicone rubber washer 68 to create a fluid-tight seal when the piston 54 is in its raised disposition under the influence of the return spring 60.

Extending through the side wall of the piston 54 and in fluid communication with the lumen 62 thereof, is a small port 72 as will be explained further hereinbelow, the liquid to be dispensed contained in the inner reservoir 46 and acted on by air pressure within the chamber 44 escapes through the interface between the neck 52 of the inner reservoir and the cup-shaped sleeve 69 to normally fill the annular chamber 74 defined between the floor 50 of the radial flange 48 and the annular flange 70 of the cup-shaped sleeve 69. Due to the sealing action between the silicone washer 68 and the annular flange 70, the liquid in the annular chamber 74 cannot reach the open port 72 formed through the wall of the tubular piston 54. Upon depression of the push-button 64, however, the cup-shaped sleeve 69 moves downward with the tubular piston 54, causing the flange 70 to separate from the undersurface of the washer 68 and allowing the liquid to be dispensed to reach the port 72. At the same time, the undersurface of the radial flange 70 engages the valve member 58, pushing it to an open condition and allowing compressed air in the chamber 44 to mix with the liquid to be dispensed and forcing the air/liquid mixture up the hollow center lumen 62 of the piston 54 and to exit through the port 66 formed in the push-button 64. By allowing a charge of compressed air to mix with the product, the bore 62 and nozzle 66 remain clean and do not become plugged even when a lacquer is being dispensed.

Upon release of the push-button, the return spring 60 again moves the piston 54 upward to the point where the radial flange 70 again seals against the undersurface of the silicone washer 68 and allowing the valve 58 to reclose to prevent the escape of the charge of pressurized air within the chamber 44. It is to be noted that the liquid to be dispensed remains out of contact with the spring 60 and the exterior surface of the hollow piston 54, thus minimizing any tendency for the piston to gum up and stick.

When a point is reached where the spray exiting the port 66 seems weak, the user may recharge the container with compressed air by manipulating the built-in piston pump at the lower end of the container 2 in the manner previously described. When the inner reservoir becomes empty, the user may unscrew the cap and drop in a new filled replacement.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A spray bottle for dispensing a liquid product as a mist, comprising:

(a) a generally cylindrical container having opened upper and lower ends;

(b) a cap member attached to the upper open end, the cap member having an aperture extending therethrough;

(c) a base member concentrically disposed about the lower end of the container and reciprocally slidable thereon;

(d) a compliant, tubular inner reservoir having a closed lower end and an upper end terminating in a rigid, radially extending flange dimensioned to fit over the upper end of the container and held in place by the cap member with the inner reservoir disposed within the cylindrical container for holding the liquid product, the rigid flange including a central bore aligned with the aperture in the cap;

(e) dispensing valve means disposed in the central bore in said rigid flange and extending through the aperture in the cap member, said dispensing valve means including a spring operatively disposed between a tubular valve stem and said rigid flange, the tubular valve stem having a closed lower end, an open upper end, a lumen extending therebetween and a port extending through a side wall of the tubular valve stem to said lumen;

(f) manually operated plunger pump means affixed to the base member for introducing pressurizing air into the container as the base member is reciprocally slid relative to the container, the port being in fluid communication with the liquid product and pressurizing air upon depression of the tubular valve stem against the force of the spring to allow a mixture of said liquid product and the pressurizing air to be dispensed through the open upper end of the tubular valve stem and with the spring being isolated from the liquid product.

2. The spray bottle as in claim 1 wherein the container includes a transversely extending baffle having a plurality of ports formed therethrough, the plunger pump means having a one-way check valve cooperating with the plurality of ports to open and close the ports as the base member is reciprocally slid relative to the container.

3. The spray bottle as in claim 2 wherein the container includes a cylindrical bore disposed beneath the baffle and the plunger pump includes a piston affixed to the base member and slidable within the cylindrical bore.

4. The spray bottle as in claim 1 and further including a push-button member secured to the upper end of the tubular valve stem and projecting through the aperture in the cap member, the push-button member having a spray outlet orifice in fluid communication with the lumen of the tubular valve stem.

5. The spray bottle as in claim 1 wherein the dispensing valve further includes an elastomeric washer having a central opening for receiving the tubular valve stem therethrough, the washer being held in place by the cap member and a radially extending flange affixed to and movable with the tubular valve stem, the flange cooperating with the washer to create a fluid-tight seal, preventing the liquid product from reaching the port proximate the closed lower end of the tubular piston until the tubular valve stem is manually depressed.

6. The spray bottle as in claim 1 and further including a second bore extending through the rigid flange and a further valve means disposed in the second bore for allowing the flow of the pressurizing air from the container to mix with the liquid product only when the tubular valve stem is depressed.

* * * * *